US008944017B2

(12) United States Patent
Glassford

(10) Patent No.: US 8,944,017 B2
(45) Date of Patent: Feb. 3, 2015

(54) POWERTRAIN COOLING SYSTEM WITH COOLING AND HEATING MODES FOR HEAT EXCHANGERS

(71) Applicant: GM Global Technology Operations LLC, Detroit, MI (US)

(72) Inventor: Daniel B. Glassford, Dryden, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 68 days.

(21) Appl. No.: 13/905,497

(22) Filed: May 30, 2013

(65) Prior Publication Data

US 2014/0352636 A1 Dec. 4, 2014

(51) Int. Cl.

| | |
|---|---|
| ***F01P 9/00*** | (2006.01) |
| ***F01P 7/14*** | (2006.01) |
| ***F01P 7/02*** | (2006.01) |
| ***F01P 11/08*** | (2006.01) |
| ***F01P 7/16*** | (2006.01) |
| ***F01P 3/12*** | (2006.01) |

(52) U.S. Cl.

CPC ... *F01P 7/16* (2013.01); *F01P 3/12* (2013.01); *F01P 2007/146* (2013.01)

USPC ..... 123/41.08; 123/41.01; 123/41.02; 123/41.09; 123/41.12; 123/41.33

(58) Field of Classification Search

USPC ..... 123/41.01, 41.02, 41.08, 41.33, 41.12; 236/34.5; 165/202, 297

See application file for complete search history.

(56) References Cited

U.S. PATENT DOCUMENTS

| | | | | |
|---|---|---|---|---|
| 3,595,262 | A * | 7/1971 | Fox et al. | 137/457 |
| 4,319,547 | A * | 3/1982 | Bierling | 123/41.29 |
| 7,069,880 | B2 * | 7/2006 | Hutchins | 123/41.29 |
| 2014/0000536 | A1 * | 1/2014 | Glassford | 123/41.08 |

* cited by examiner

*Primary Examiner* — Lindsay Low
*Assistant Examiner* — Tea Holbrook
(74) *Attorney, Agent, or Firm* — Quinn Law Group, PLLC

(57) ABSTRACT

A cooling system has an engine heat exchanger in thermal communication with engine oil in an engine. A transmission heat exchanger is in thermal communication with transmission oil in a transmission. A pump has a pump inlet and a pump outlet. A valve assembly is in fluid communication with the pump outlet and has a first and a second position that at least partially establish different coolant flow modes through a plurality of coolant flow passages. The valve assembly has a first inlet that receives coolant that flows from the pump outlet, to an engine inlet, then through the engine to an engine outlet. The valve assembly has a second inlet that receives coolant that flows from the pump outlet and bypasses the engine. The valve assembly has a single outlet that directs coolant flow to at least one of the engine heat exchanger and the transmission heat exchanger.

16 Claims, 3 Drawing Sheets

POWERTRAIN COOLING SYSTEM WITH COOLING AND HEATING MODES FOR HEAT EXCHANGERS

TECHNICAL FIELD

The present teachings generally include a cooling system for a vehicle powertrain.

BACKGROUND

In a vehicle powertrain, operating temperatures of an engine and a transmission are typically managed in part by a cooling system that has circulating coolant. An engine heat exchanger establishes thermal communication between engine oil and the coolant. A transmission heat exchanger establishes thermal communication between transmission fluid and the coolant. Coolant flow to the heat exchangers is typically via the same route whether in a cooling mode or in a heating mode. The heat exchangers must be sized to sufficiently perform the cooling and heating tasks.

SUMMARY

A cooling system for a vehicle powertrain is provided that controls the source of coolant flow to the heat exchangers using one or more valves. This enables relatively warmer coolant to be used for fluid heating, and relatively cooler coolant to be used for cooling. The heat exchangers can more efficiently perform the separate heating and cooling tasks when the coolant flow source is selected in this manner, potentially reducing friction losses and increasing fuel economy. Additionally, because the heat exchangers are more efficient, they may be a relatively smaller size than if the same coolant flow route was used for both heating and cooling, thereby realizing the fuel economy benefits associated with a decrease in overall weight.

Specifically, a cooling system is provided for a powertrain that has an engine and a transmission driven by the engine. The cooling system has an engine heat exchanger in thermal communication with engine oil in the engine. A transmission heat exchanger is in thermal communication with transmission oil in the transmission. A pump has a pump inlet and a pump outlet. The pump pumps coolant through a plurality of coolant flow passages. A valve assembly is in fluid communication with the pump outlet and has a first and a second position that at least partially establish different coolant flow modes through the coolant flow passages.

The valve assembly has a first inlet that receives coolant that flows from the pump outlet, to an engine inlet, then through the engine to an engine outlet. The valve assembly also has a second inlet that receives coolant that flows from the pump outlet and bypasses the engine. The valve assembly has only a single outlet that directs coolant flow to at least one of the engine heat exchanger and the transmission heat exchanger, and then back to the pump inlet. The first position of the valve assembly fluidly connects the first inlet to the single outlet and blocks the second inlet to establish a first of the coolant flow modes. The second position of the valve assembly fluidly connects the second inlet to the single outlet and blocks the first inlet to establish a second of the coolant flow modes.

Because coolant flowing to the first inlet flows through the engine, and coolant flowing to the second inlet bypasses the engine, a heating mode is established when the valve assembly is in the first position, and a cooling mode is established when the valve assembly is in the second position. The valve assembly is operable to move from the first position to the second position in response to a first predetermined operating condition. For example, the first predetermined operating condition may be a predetermined coolant temperature at which the system switches from a heating mode to a cooling mode.

In one aspect of the present teachings, the valve assembly is a first valve assembly that controls coolant flow to the engine heat exchanger, and a second valve assembly configured to function in a similar manner controls coolant flow to the transmission heat exchanger. A second predetermined operating condition different than the first predetermined operating condition can cause the second valve assembly to be moved to the second position. In this manner, the conditions under which the engine heat exchanger is changed from a heating mode to a cooling mode can be different than the conditions under which the transmission heat exchanger is changed from a heating mode to a cooling mode. Heating and cooling of the engine and the transmission can thus be separately optimized.

The position of the valve assembly can be controlled by a controller and an actuator. Alternatively, the valve assembly can be a mechanical valve assembly that self-actuates, such as a valve assembly that has a wax motor thermostat at one inlet that is actuated by the coolant at a predetermined temperature, and a ball valve at the other inlet.

The above features and advantages and other features and advantages of the present teachings are readily apparent from the following detailed description of the best modes for carrying out the present teachings when taken in connection with the accompanying drawings.

DETAILED DESCRIPTION

Figure 1:
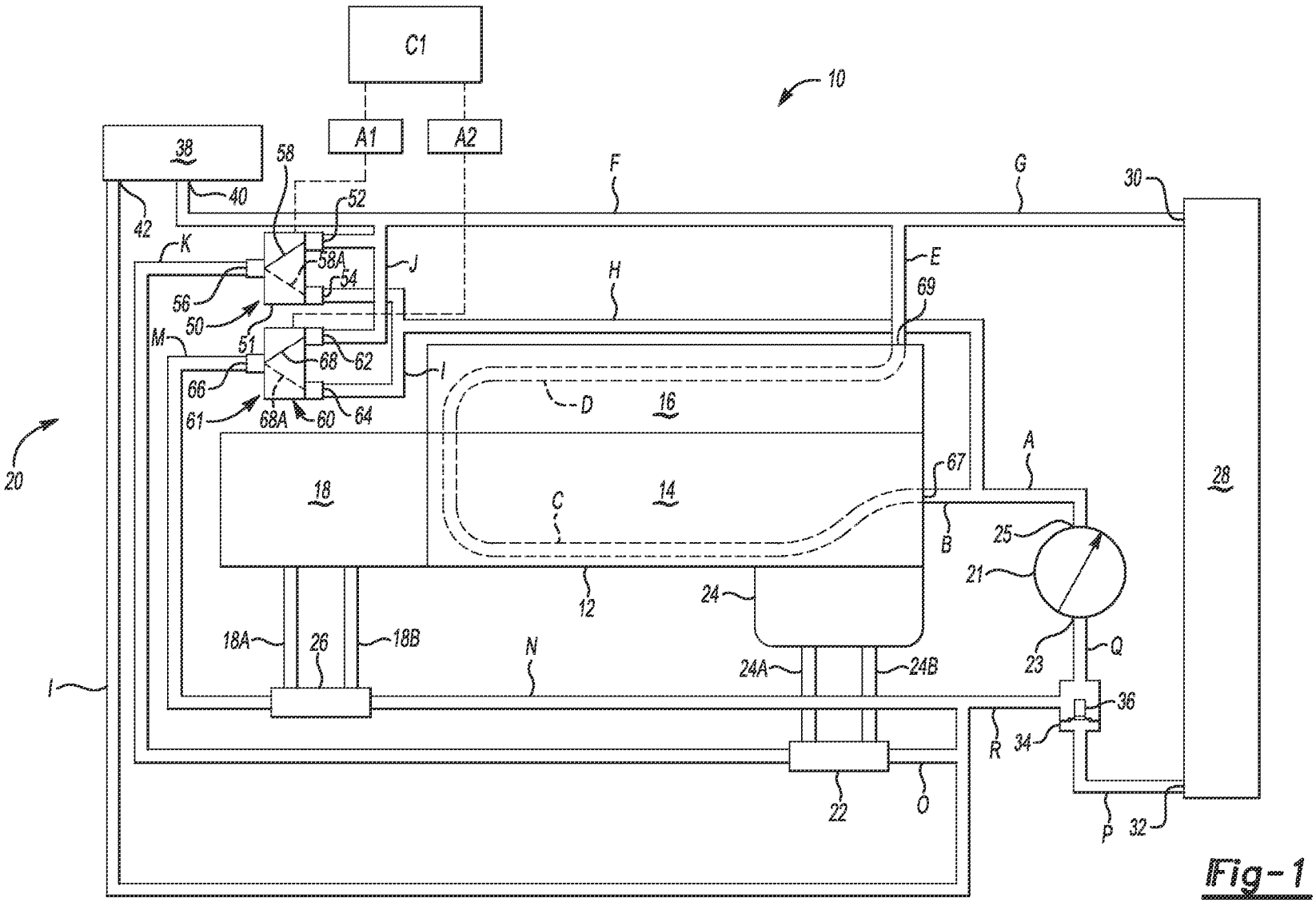
FIG. 1 is a schematic illustration in plan view of a first embodiment of a powertrain with a cooling system in accordance with one aspect of the present teachings.

Referring to the drawings, wherein like components are referred to with identical reference numbers throughout the several views, FIG. 1 shows a vehicle powertrain 10 that has an engine 12 that includes an engine block 14 and a cylinder head 16. A transmission 18 is driven by the engine 12 and provides power to vehicle wheels (not shown). The engine 12 can be a spark-ignited or combustion ignition internal combustion engine. The transmission 18 can be any suitable type of transmission, including an automatic transmission, a continuously variable transmission, or a manual transmission.

The powertrain 10 has a cooling system 20 with a plurality of coolant flow passages A, B, C, D, E, F, G, H, I, J, K, L, M, N, O, P, Q, and R containing coolant that is moved through the passages via a pump 21. Specifically, when the pump 21 is powered, coolant is pumped from passage Q to a pump inlet 23, through the pump 21 to a pump outlet 25, and then to passage A. The pump 21 can be driven by the engine 12, or can be separately powered. The route of the coolant through the remaining passages is dependent upon the position of valve assemblies 50, 60, and an engine thermostat valve 34 as discussed herein.

The cooling system 20 is configured to warm or cool the engine 12 and the transmission 18 as appropriate for varying vehicle operating conditions, as described herein. The cooling system 20 includes an engine heat exchanger 22 that cools or heats engine oil contained in the engine 12 via heat exchange between the engine oil and the coolant. The engine oil can be routed between an engine sump 24 and the heat exchanger 22 via engine oil passages 24A, 24B. Alternatively, the engine oil can be routed from a passage in the engine block 14 to the heat exchanger 22, or from another portion of the engine 12. Coolant flows through the heat exchanger 22 from passage K to passage O.

The cooling system 20 further includes a transmission heat exchanger 26 that cools or heats transmission oil contained in the transmission 18 via heat exchange between the transmission oil and the coolant. The transmission oil routes between the transmission 18 and the heat exchanger 26 via transmission oil passages 18A, 18B, and coolant flows through the heat exchanger 26 from passage M to passage N.

The cooling system 20 includes a radiator 28 with a coolant inlet 30 and a coolant outlet 32. The radiator 28 is configured to cause convective cooling of the coolant as air rushes over conduits (not shown) in the radiator 28 through which the coolant flows from the coolant inlet 30 to the coolant outlet 32. An engine thermostat valve 34 controls whether coolant flows through the radiator 28. In the closed position shown, the thermostat valve 34 prevents coolant flow from the radiator outlet 32 to the remainder of the cooling system 20. In an open position, a thermostat valve member 36 will open to allow flow from passage P to passage Q, thereby enabling flow from passage G, to the coolant input 30, through the radiator 28 to the coolant outlet 32, and to the passage P. The engine thermostat 34 can be configured to open when the coolant temperature flowing into the pump 21 reaches a predetermined temperature that indicates additional cooling is necessary.

The cooling system 20 has a passenger compartment heater 38 with a coolant inlet 40 and a coolant outlet 42. Coolant flowing through the heater 38 undergoes heat exchange with air in a vehicle passenger compartment to warm the air.

The cooling system 20 has a first valve assembly 50 that has a housing 51 that forms a first inlet 52, a second inlet 54, and a single outlet 56. The first valve 50 has an internal valve member 58 that is selectively moveable from a first position shown in solid, to a second position 58A shown in phantom. When the valve member 56 is in the first position, coolant can flow from the first inlet 52 to the single outlet 58 but cannot flow from the second inlet 54 to the single outlet 56. When the valve member 58 is in the second position 58A, coolant can flow from the second inlet 54 to the single outlet 56 but cannot flow from the first inlet 52 to the single outlet 56.

In the embodiment shown, the first valve assembly 50 is moved by an actuator A1 under the control of a controller C1. The controller C1 receives a sensor signal from a sensor (not shown) that indicates a first predetermined operating condition is occurring. The controller C1 then sends an activation signal or other activating input to the actuator A1 to cause the actuator A1 to move the valve member 58 from the first position to the second position 58A. The controller C1 and actuator A1 can utilize electric, pneumatic, hydraulic, or electro-mechanical control of the valve member 58.

The cooling system 20 has a second valve assembly 60 that has a housing 61 that forms inlet 62, inlet 64, and a single outlet 66. The inlet 62 can be referred to as a first inlet and the inlet 64 can be referred to as a second inlet, or, to differentiate from the inlets 50, 54 of valve assembly 50, can be referred to as a third inlet, and a fourth inlet, respectively. The first valve assembly 60 has an internal valve member 68 that is selectively moveable from a first position shown in solid, to a second position 68A shown in phantom. To differentiate from the first valve assembly 50, the first position of the valve member 68 can be referred to as a third position, and the second position 68A of the valve member 68 can be referred to as a fourth position. When the valve member 68 is in the first position, coolant can flow from the first inlet 62 to the single outlet 66 but cannot flow from the second inlet 64 to the single outlet 66. When the valve member 68 is in the second position 68A, coolant can flow from the second inlet 64 to the single outlet 66 but cannot flow through the first inlet 62.

In the embodiment shown, the second valve assembly 60 is moved by an actuator A2 under the control of a controller C1. The controller C1 receives a sensor signal from a sensor (not shown) that indicates a second predetermined operating condition is occurring. The controller C1 then sends an activation signal or other activating input to the actuator A2 to cause the actuator A2 to move the valve member 68 from the first position to the second position 68A. The controller C1 and actuator A1 can utilize electric, pneumatic, hydraulic, or electro-mechanical control of the valve member 68.

When the first valve assembly 50 is in the first position (i.e., valve member 58 is in the first position), a first coolant flow mode through the cooling system 20 results, with the coolant flowing through a first route. The first route includes coolant flow from the pump outlet 25, through passages A, B, C, D, E, F, and J to the first inlet 52. The passages C and D are internal cast passages in the engine bock 14 and the cylinder head 16, respectively. Coolant flows though passages C and D from an engine inlet 67 to an engine outlet 69. By routing the coolant through the engine block 14 and cylinder head 16, the coolant is warmed by the engine 12 prior to flowing through the engine heat exchanger 22.

Alternatively, if the first valve assembly 50 is in the second position 58A, a second coolant flow mode through the cooling system 20 results, with coolant flowing through a second route. The second route includes coolant flow from the pump outlet 25 through passages A, H, and I to the second inlet 54, bypassing the internal passages C and D in the engine 12. The coolant is thus not warmed by the engine 12 prior to flowing through the engine heat exchanger 22.

When the second valve assembly 60 is in the first position, another coolant flow mode through the cooling system 20 results, with the coolant flowing through a third route. This coolant flow mode can be referred to as a third coolant flow mode. The third route includes coolant flow from the pump outlet 25, through passages A, B, C, D, E, F, and J to the first inlet 62. By routing the coolant through the engine block 14 and cylinder head 16, the coolant is warmed by the engine 12 prior to flowing through the transmission heat exchanger 26.

Alternatively, if the second valve assembly 60 is in the second position 68A, a different coolant flow mode through the cooling system 20 results, with coolant flowing through still another route. This coolant flow mode can be referred to as a fourth coolant flow mode. Coolant will flow from the pump outlet 25 through passages A, H, and I to the second inlet 64, bypassing the internal passages C and D in the engine 12. The coolant is thus not warmed by the engine 12 prior to flowing through the heat exchanger 26.

A portion of the coolant in passage F will flow through the passenger compartment heater 38 and flow back to the pump 21 through passages L and R. Any coolant flowing through passage L, as well as coolant flowing through passage N after exiting the transmission heat exchanger 26, and coolant flowing through passage O after exiting the engine heat exchanger 22 converge at passage R and flow through the engine thermostat 34 back to the pump inlet 23. If the engine thermostat 34 is opened, a portion of the coolant flowing out of the engine 12 through passage E will be diverted through passage G, through the radiator 28 and back to the pump 21 through passages P and Q.

The controller C1 is configured to execute a stored algorithm that activates the actuators A1 and A2 in response to different predetermined operating conditions to ensure sufficient heating of the engine 12 and the transmission 18 by directing relatively warm coolant that has flowed through the engine 12 to one or both of the heat exchangers 22, 26 when operating conditions indicate that fluid heating is necessary. Maintaining the transmission fluid and the engine oil at a desirable temperature can reduce frictional losses caused by the drag of rotating components through unwarmed, relatively viscous, fluid or oil. Accordingly, the first valve assembly 50 remains in the first position until a first predetermined operating condition, such as a predetermined temperature of the coolant exiting the engine 12 at engine outlet 69 is attained, as determined by a temperature sensor (not shown). At that point, the controller C1 causes the actuator A1 to move the valve member 58 to the second position 58A, establishing a cooling mode in which relatively cool coolant will instead be directed to the engine heat exchanger 22 to help cool the engine oil, or maintain it within an ideal range.

Similarly, the controller C1 can maintain the second valve assembly 60 in the first position until transmission fluid temperature reaches a predetermined temperature, which can be the same or different that the engine oil temperature at which the first valve assembly 50 is moved. This predetermined temperature is referred to as the second predetermined operating condition. Once the transmission fluid temperature is reached, the controller C1 causes the actuator A2 to move the valve member 68 to the second position 68A, to begin cooling of the transmission fluid or maintaining it within an ideal range.

The movement of the valve assembly 50 from the first position to the second position, or the movement of the valve assembly 60 from the first position to the second position effectively allows the controller C1 to choose the coolant source by varying the route of the coolant entering the respective heat exchanger 22 or 26. By controlling the coolant source, the engine heat exchanger 22 and the transmission heat exchanger 26 can be of a reduced size in comparison to a cooling system in which only a single flow path for the coolant was available.

The controller C1 can be configured to activate the actuator A1 to move the valve member 58 back to the first position if operating conditions are such that the heating mode of the engine 12 should be resumed. Similarly, the controller C1 can be configured to activate the actuator A2 to move the valve member 68 back to the first position if operating conditions are such that the heating mode of the transmission 18 should be resumed.

Figure 2:
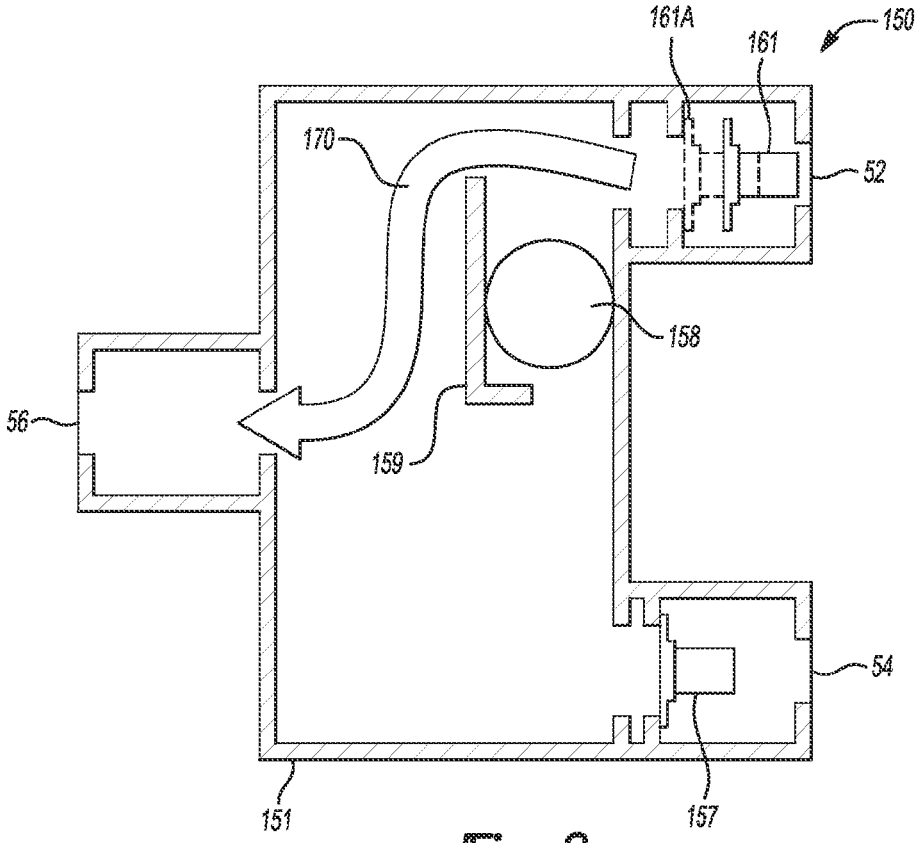
FIG. 2 is a schematic illustration in partial cross sectional view of an alternative valve assembly that can be used in the cooling system of FIG. 1 or 4, with the valve assembly shown in a first position.
Figure 3:
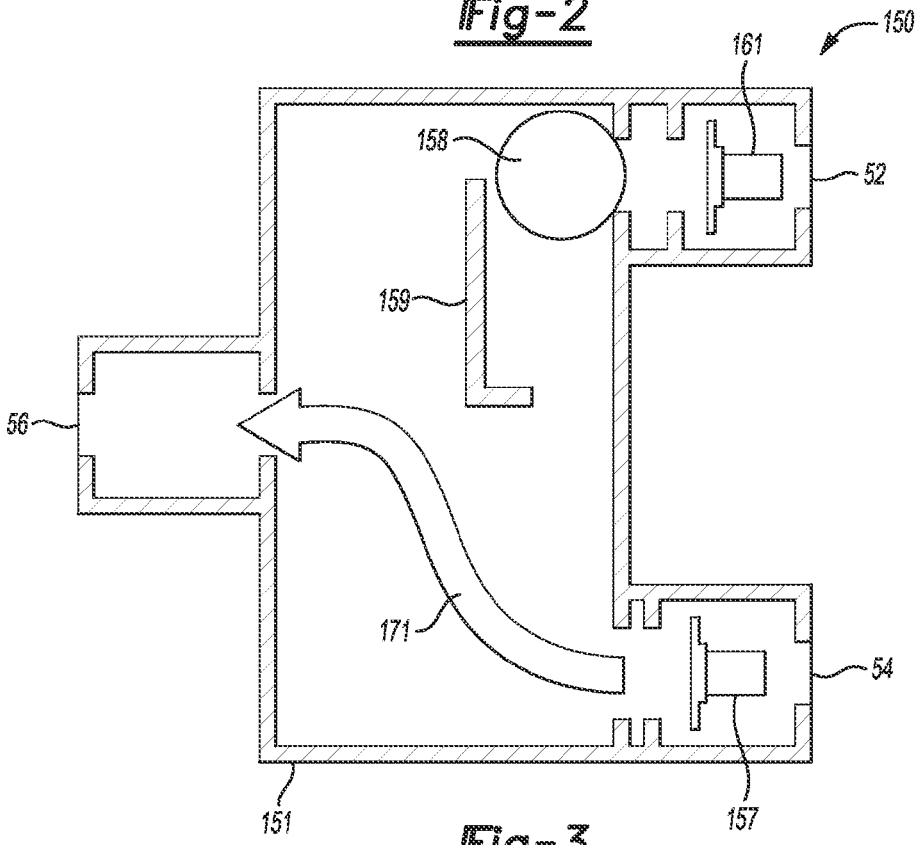
FIG. 3 is a schematic illustration in partial cross-sectional view of the valve assembly of FIG. 2 in a second position.

FIGS. 2 and 3 show a mechanical valve assembly 150 that can be used in place of the first valve assembly 50 in the cooling system 20 of FIG. 1. Another duplicate mechanical valve assembly 150 can also be used in place of the second valve assembly 60 in the cooling system 20 of FIG. 1. The valve assembly 150 has an identical first inlet 52, the second inlet 54, and the single outlet 56 as the valve assembly 50 positioned in the same location in the cooling system 20 as when the valve 50 is used. A duplicate valve assembly 150 can also replace valve assembly 60, with the inlets 52, 54 and single outlet 56 shown in FIGS. 2 and 3 instead being inlets 62, 64, and single outlet 66.

The valve assembly 150 is a mechanical valve assembly that utilizes temperature of the coolant to establish the first or the second cooling flow mode. Accordingly, a controller and actuator are not required. Specifically, the valve assembly 150 includes a housing 151 that forms the first inlet 52, the second inlet 54, and the single outlet 56. A ball valve 158 is configured to be supported within the housing 151 to selectively block flow from the first inlet 52. A first wax motor thermostat 157 is positioned at the second inlet 54 and is configured to close the second inlet 54 when temperature of the coolant flowing from the pump outlet 25 and bypassing the engine 12 is below a first predetermined temperature. The first wax motor thermostat 157 is shown closing the second inlet 54 in FIG. 2. The first wax motor thermostat 157 is configured to open the second inlet 54, as shown in FIG. 3, when the temperature of the coolant flowing from the pump outlet 25 and bypassing the engine 12 is above the first predetermined temperature, allowing coolant to flow from the second inlet 54 to the single outlet 56 through the housing 151 as represented by arrow 171 in FIG. 3.

The ball valve 158 and housing 151 are configured so that the ball valve 158 unblocks the first inlet 52 when the first wax motor thermostat 157 blocks flow from the second inlet 54, and blocks the first inlet 52 when the first wax motor thermostat 157 unblocks flow from the second inlet 54. That is, the high pressure from the coolant entering at the second inlet 54 displaces the ball valve 158 to the position of FIG. 3 to block flow from the first inlet 52. The housing 151 has an internal guide wall 159 that maintains the ball valve 158 in the unblocking position of FIG. 2, and in the blocking position of FIG. 3. The guide wall 159 and the ball valve 158 can be referred to as a "ball-in-cage" valve.

The valve assembly 150 has an optional second wax motor thermostat 161 positioned at the first inlet 52. The second wax motor thermostat 161 is shown in an open position in both FIGS. 2 and 3. A closed position of the second wax motor thermostat 161 is represented in phantom at 161A in FIG. 2. The second wax motor thermostat 161 is configured to close the first inlet 52 (i.e., to be in the position 161A) when temperature of the coolant flowing from the pump outlet 25 and through the engine 12 is less than a second predetermined temperature. This ensures that heating of the engine oil via the engine heat exchanger 22 does not begin until the coolant temperature is at least the second predetermined temperature. Once the coolant temperature reaches the second predetermined temperature, the second wax motor thermostat 161 moves to the open position. Coolant then flows through the housing from the first inlet 52 to the single outlet 56 as represented by arrow 170 shown in FIG. 2.

The coolant flowing from the second inlet 54 to the single outlet 56 in the cooling mode of FIG. 3 will be cooler than the coolant that flows from the first inlet 52 to the single outlet 56 in the heating mode of FIG. 2. The first predetermined temperature that triggers opening of the first wax motor thermostat 157 can be greater than the second predetermined temperature. This ensures that the heating mode occurs until a desired coolant temperature out of the pump 21 is achieved, at which point the cooling mode will occur.

Figure 4:
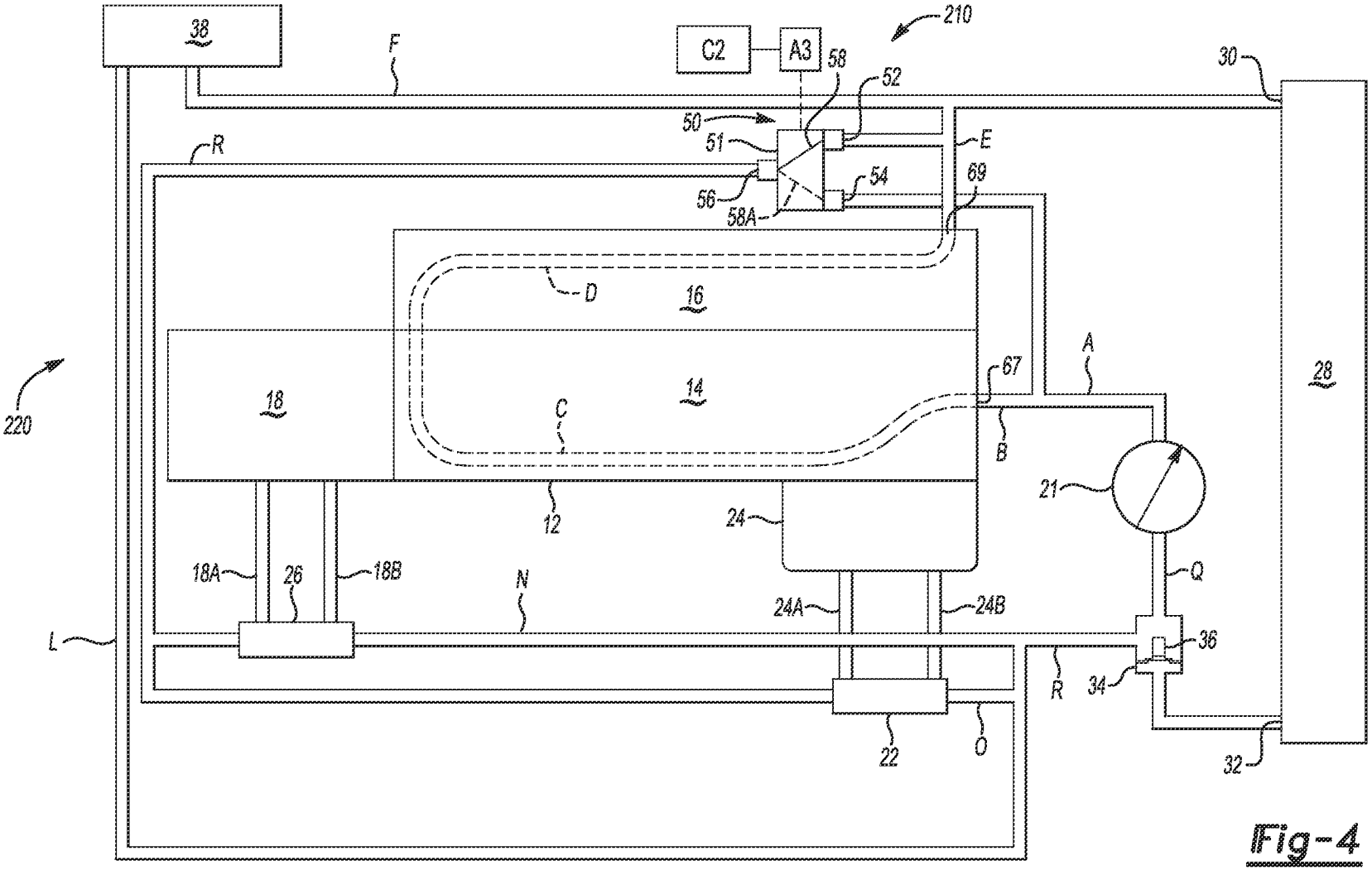
FIG. 4 is a schematic illustration in plan view of a second embodiment of a powertrain with a cooling system in accordance with an alternative aspect of the present teachings.

FIG. 4 shows another embodiment of a powertrain 210 with a cooling system 220. The powertrain 210 and cooling system 220 have many of the same components as the powertrain 10 and the cooling system 20 of FIG. 1, as indicated by like reference numbers. In the cooling system 220, passages K and M are replaced by a single passage R, and the second valve assembly 60 is eliminated so that valve assembly 50 controls coolant flow to both the transmission heat exchanger 26 and the engine heat exchanger 22. A controller C2 controls a single actuator A3 to move a valve member 58 from a first position shown to a second position 58A represented in phantom. In this embodiment, the first predetermined operating condition at which the valve member 58 is moved by the actuator A3 determines the switch from the heating mode to the cooling mode for both of the heat exchangers 22, 26.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. A cooling system for a powertrain; wherein the powertrain has an engine and a transmission driven by the engine, the cooling system comprising:

an engine heat exchanger in thermal communication with engine oil in the engine;

a transmission heat exchanger in thermal communication with transmission fluid in the transmission;

a pump having a pump inlet and a pump outlet;

a plurality of coolant flow passages through which coolant is pumped by the pump;

a valve assembly in fluid communication with the pump outlet and having a first and a second position that at least partially establish different coolant flow modes through the coolant flow passages; wherein the valve assembly has:

a first inlet that receives coolant that flows from the pump outlet, to an engine inlet, then through the engine to an engine outlet;

a second inlet that receives coolant that flows from the pump outlet and bypasses the engine; and a single outlet that directs coolant flow to at least one of the engine heat exchanger and the transmission heat exchanger, and then back to the pump inlet; and wherein the first position of the valve assembly fluidly connects the first inlet to the single outlet and blocks flow from the second inlet to establish a first of said coolant flow modes; wherein the second position of the valve assembly fluidly connects the second inlet to the single outlet and blocks flow from the first inlet to establish a second of said coolant flow modes; and wherein the valve assembly is operable to move from the first position to the second position in response to a first predetermined operating condition.

2. The cooling system of claim 1, wherein the single outlet directs coolant flow to both the engine heat exchanger and the transmission heat exchanger.

3. The cooling system of claim 1, further comprising:

a controller;

an actuator operatively connected to the controller and to the valve assembly; and wherein the controller is configured to cause the actuator to move the valve assembly from the first position to the second position upon a determination of the first predetermined operating condition.

4. The cooling system of claim 1, wherein the valve assembly is a mechanical valve assembly that includes:

a housing that forms the first inlet, the second inlet, and the single outlet;

a ball valve configured to be supported within the housing to selectively block the first inlet;

a wax motor thermostat positioned at the second inlet and configured to block flow from the second inlet when temperature of the coolant flowing from the pump outlet and bypassing the engine is below a first predetermined temperature, and unblock flow from the second inlet when temperature of the coolant flowing from the pump outlet and bypassing the engine is above the first predetermined temperature; and wherein the ball valve and housing are configured so that the ball valve unblocks flow from the first inlet when the wax motor thermostat closes the second inlet, and blocks flow from the first inlet when the wax motor thermostat opens the second inlet.

5. The cooling system of claim 4, wherein the wax motor thermostat is a first wax motor thermostat, and further comprising:

a second wax motor thermostat positioned at the first inlet and configured to block flow from the first inlet when temperature of the coolant flowing from the pump outlet and through the engine is below a second predetermined temperature, and unblock flow from the first inlet when the temperature of the coolant flowing from the pump outlet and through the engine is above the second predetermined temperature.

6. The cooling system of claim 1, wherein the valve assembly is a first valve assembly and the single outlet of the first valve assembly is a first single outlet that directs fluid to the engine heat exchanger and not to the transmission heat exchanger; and further comprising:

a second valve assembly in fluid communication with the pump outlet and having a first and a second position that at least partially establish different coolant flow modes through the coolant flow passages; wherein the second valve assembly has:

a third inlet that receives coolant that flows from the pump outlet, to an engine inlet, then through the engine to an engine outlet;

a fourth inlet that receives coolant that flows from the pump outlet and bypasses the engine; and a second single outlet that directs coolant flow to the transmission heat exchanger and not to the engine heat exchanger, and then back to the pump inlet;

wherein the first position of the second valve assembly fluidly connects the third inlet to the second single outlet and blocks flow from the fourth inlet to establish a third of said coolant flow modes; wherein the second position of the second valve assembly fluidly connects the fourth inlet to the second single outlet and blocks flow from the third inlet to establish a fourth of said coolant flow modes; and wherein the second valve assembly is operable to move from the first position to the second position in response a second predetermined operating condition.

7. The cooling system of claim 6, further comprising:

a second actuator operatively connected to the second valve assembly and to the controller; and wherein the controller is configured to cause the second actuator to move the second valve assembly from the first position to the second position upon a determination of the second predetermined operating condition.

8. The cooling system of claim 6, wherein the second valve assembly is a mechanical valve assembly with a housing that forms the third inlet, the fourth inlet, and the second single outlet, and that includes:

a ball valve configured to be supported within the housing to selectively block the third inlet;

a wax motor thermostat positioned at the fourth inlet and configured to block flow from the fourth inlet when temperature of the coolant flowing from the pump outlet and bypassing the engine is below a third predetermined temperature, and unblock flow from the fourth inlet when temperature of the coolant flowing from the pump outlet and bypassing the engine is above the third predetermined temperature; and wherein the ball valve and housing are configured so that the ball valve unblocks flow from the third inlet when the wax motor thermostat closes the fourth inlet, and blocks flow from the third inlet when the wax motor thermostat opens the fourth inlet.

9. The cooling system of claim 8, wherein the wax motor thermostat is a first wax motor thermostat, and further comprising:

a second wax motor thermostat positioned at the third inlet and configured to block flow from the third inlet when temperature of the coolant flowing from the pump outlet, to an engine inlet, then through the engine to an engine outlet is less than a fourth predetermined temperature, and unblock flow from the third inlet when the temperature of the coolant flowing from the pump outlet and through the engine is greater than the fourth predetermined temperature.

10. The cooling system of claim 1, further comprising:

a radiator having a coolant entrance in fluid communication with the engine outlet, and having a coolant outlet;

an engine thermostat valve in fluid communication with the coolant outlet and with coolant flowing from the transmission heat exchanger and the engine heat exchanger; wherein the engine thermostat valve has a closed position that blocks coolant flow from the coolant outlet to the pump, and an open position that permits coolant flow from the coolant outlet to the pump; and wherein the engine thermostat valve is configured to move from the closed position to the open position based at least partially on a temperature of coolant flowing to the engine thermostat valve from the transmission heat exchanger and the engine heat exchanger.

11. The cooling system of claim 10, further comprising:

a passenger compartment heater having a coolant inlet in fluid communication with the engine outlet, and having a coolant outlet in fluid communication with the engine thermostat valve;

when temperature of coolant flowing to the engine thermostat valve from the transmission heat exchanger, the engine heat exchanger, and the passenger compartment heater is above a predetermined coolant temperature.

12. A powertrain comprising:

an engine;

an engine heat exchanger in thermal communication with engine oil in the engine;

a transmission driven by the engine;

a transmission heat exchanger in thermal communication with transmission oil in the transmission;

a pump having a pump inlet and a pump outlet;

a plurality of coolant flow passages that operatively connect the pump, the engine, the engine heat exchanger, and the transmission heat exchanger and through which coolant flows via the pump;

a valve assembly configured to permit coolant flow through the coolant flow passages from the pump outlet to at least one of the transmission heat exchanger and the engine heat exchanger via a first route when the valve assembly is in a first position, and via a second route when the valve assembly is in a second position; wherein the first route is from the pump outlet, to an engine inlet, then through the engine to an engine outlet, and the second route bypasses the engine.

13. The powertrain of claim 12, further comprising:

a controller;

an actuator operatively connected to the controller and to the valve assembly; and wherein the controller is configured to cause the actuator to move the valve assembly from the first position to the second position upon a determination of a first predetermined operating condition.

14. The powertrain of claim 12, wherein the valve assembly is a mechanical valve assembly that includes:

a housing that forms:

a first inlet that receives coolant that flows from the pump outlet via the first route;

a second inlet that receives coolant that flows from the pump outlet via the second route; and a single outlet that directs coolant flow to said at least one of the engine heat exchanger and the transmission heat exchanger, and then back to the pump inlet;

a ball valve configured to be supported within the housing to selectively block flow from the first inlet;

a wax motor thermostat positioned at the second inlet and configured to block flow from the second inlet when temperature of the coolant flowing from the pump outlet via the second route is below a first predetermined temperature, and unblock flow from the second inlet when temperature of the coolant flowing from the pump outlet via the second route is above the first predetermined temperature; and wherein the ball valve and housing are configured so that the ball valve unblocks flow from the first inlet when the wax motor thermostat blocks flow from the second inlet, and blocks flow from the first inlet when the wax motor thermostat unblocks flow from the second inlet.

15. A powertrain comprising:

an engine with an engine heat exchanger in thermal communication with engine oil in the engine;

a transmission driven by the engine with a transmission heat exchanger in thermal communication with transmission fluid in the transmission;

a pump having a pump inlet and a pump outlet;

a plurality of coolant flow passages that operatively connect the pump, the engine, the engine heat exchanger, and the transmission heat exchanger and through which coolant flows via the pump;

a first valve assembly having a first position and a second position configured to selectively permit coolant flow to the engine heat exchanger by a first route from the pump outlet through the engine to the first valve assembly when the first valve assembly is in the first position, and by a second route from the pump outlet to the first valve assembly bypassing the engine when the first valve assembly is in the second position;

a second valve assembly having a first position and a second position; and wherein the second valve assembly is configured to selectively permit coolant flow to the transmission heat exchanger by a third route from the pump outlet through the engine to the second valve assembly when the second valve assembly is in the first position, and by a fourth route from the pump outlet to the second valve assembly bypassing the engine when the second valve assembly is in the second position.

16. The powertrain of claim 15, further comprising:

a controller;

a first actuator operatively connected to the controller and to the first valve assembly;

wherein the controller is configured to cause the first actuator to move the first valve assembly from the first position to the second position upon a determination of a first predetermined operating condition;

a second actuator operatively connected to the controller and to the second valve assembly;

wherein the controller is configured to cause the second actuator to move the second valve assembly from the first position to the second position upon a determination of a second predetermined operating condition.

* * * * *